United States Patent [19]

Barlics

[11] 4,277,004

[45] Jul. 7, 1981

[54] COVER AND AEROSOL ACTIVATOR FOR AEROSOL SPRAY CAN

[76] Inventor: John J. Barlics, 676 Denver Blvd., North Edison, N.J. 08817

[21] Appl. No.: 84,559

[22] Filed: Oct. 15, 1979

[51] Int. Cl.[3] ..... B65D 83/14

[52] U.S. Cl. ..... 222/402.14; 222/330; 222/402.13; 222/541

[58] Field of Search ..... 239/337, 548, 579; 222/330, 402.11–402.15, 541

[56] References Cited

U.S. PATENT DOCUMENTS

| | | | |
|---|---|---|---|
| 1,665,744 | 4/1928 | Landberg | 239/548 X |
| 2,753,214 | 7/1956 | Abplanalp | 239/337 X |
| 2,887,273 | 5/1959 | Anderson et al. | 239/337 |
| 3,081,918 | 3/1963 | Scoggin, Jr. et al. | 239/337 X |
| 3,225,966 | 12/1965 | Sagarin . | |
| 3,312,723 | 4/1967 | Anderson et al. | 239/579n |
| 3,314,576 | 4/1967 | Focht et al. | 222/541 |
| 3,325,064 | 6/1967 | Scheck | 222/402.14 |
| 3,804,302 | 4/1974 | Uamada et al. | 222/402.14 |
| 4,013,231 | 3/1977 | Veldhoven | 239/579 |

FOREIGN PATENT DOCUMENTS

| | | | |
|---|---|---|---|
| 898197 | 4/1972 | Canada | 222/330 |

*Primary Examiner*—Robert W. Saifer

*Attorney, Agent, or Firm*—Lerner, David, Littenberg & Samuel

[57] ABSTRACT

The present invention provides an integrated cover and aerosol activator for an aerosol spray container so that the cover does not have to be removed from the container in order to actuate the aerosol activator. The combined cover-activator is also provided with an annular locking ring on the inside surface for engaging an annular lip on the container for locking the aerosol activator in engagement with the aerosol valve when it is actuated. The cover is also provided with spring members for allowing the aerosol activator to be moved in a substantially-vertical direction to vertically move and actuate the stem of the aerosol valve. In another form of the invention, one spring is provided for allowing the activator to be moved at an angle to bend and actuate the stem of the aerosol valve.

19 Claims, 7 Drawing Figures

COVER AND AEROSOL ACTIVATOR FOR AEROSOL SPRAY CAN

FIELD OF THE INVENTION

The present invention relates generally to aerosol spray containers, and specifically to an improved cover and aerosol activator for an aerosol spray container.

BACKGROUND OF THE INVENTION

Typically, aerosol spray containers include a cover which must be removed for access to the aerosol activator for engaging and actuating the stem of the aerosol valve. Such aerosol activators may also include devices for locking the activator into engagement with the aerosol valve once it is actuated, so that the entire contents of the spary container may be dispensed. Typically, such arrangements are used in aerosol bombs which are activated and then left in a room to dispense their entire contents. In one specific prior art arrangement, the aerosol activator is formed of a plastic material and when actuated, it engages an annular rim formed of plastic material for locking the aerosol activator in engagement with the aerosol valve to dispense the entire contents of the spray container. However, such arrangements have not been generally satisfactory. More particularly, the aerosol activator is locked into engagement by a plastic-to-plastic contact, and when the temperature is relatively high, because of the melt flow characteristics of plastic material, one or both of the parts in engagement begin to soften. As a result, the locking engagement of the aerosol activator does not hold, and eventually releases before the entire contents of the spray container are dispensed. As a result, the area receiving the aerosol spray does not receive the required amount of aerosol. Accordingly, it would be highly desirable to provide a locking arrangement for an aerosol activator which is not as susceptible to high temperature conditions and the melt flow characteristics of plastic material.

In prior art arrangements, as noted above, the cover must be removed for access to the aerosol activator. However, it would be highly desirable to provide an aerosol activator which may be actuated without having to remove a separate cover. Such an arrangement would not only be easier to use, but it would result in a savings of material, since a separate cover and aerosol activator would not have to be provided. One prior art arrangement has combined the cover and activator. However, the cover must be removed and turned over in order to place the activator in engagement with the valve. However, it would be desirable to provide an integrated cover and activator which does not have to be removed and reversed before it can be used.

Accordingly, it is broadly an object of the present invention to provide an improved cover and aerosol activator which overcomes one or more of the aforesaid problems. Specifically, it is within the contemplation of the present invention to provide a combined cover and activator arrangement so that the cover does not have to be removed to use the aerosol activator.

It is a further object of the present invention to provide an improved aerosol activator which will stay engaged after it is actuated and is not subject to slipping out of engagement as a result of temperature conditions and the melt flow characteristics of plastic material.

It is a still further object of the present invention to provide an improved cover for an aerosol spray container which is provided with an improved locking rim arrangement for more securely attaching the cover to the aerosol spray container.

It is a still further object of the present invention to provide an improved aerosol activator which is moved vertically to actuate a valve stem in a vertical direction.

It is also an object of the present invention to provide an aerosol activator which is child proof in that it cannot be inadvertently actuated by a child.

SUMMARY OF THE INVENTION

Briefly, in accordance with the principles of the present invention, an improved cover and aerosol activator for an aerosol spray container is provided. In one aspect of the present invention, the cover performs the dual function of covering the aerosol spray container and also includes an aerosol activator integrally formed therewith. In use, the cover does not have to be removed in order to move the aerosol activator into engagement with the aerosol valve. Specifically, the improved dual cover arrangement includes an outer circular wall for engaging the top of the spray container and a top wall connected to the circular wall for covering the aerosol valve. The aerosol activator is integrally formed on the inside surface of the top wall for activating the aerosol valve. Movable spring means are provided for connecting the top wall to the circular wall for allowing the top wall and the aerosol activator to be moved relative to the circular wall to activate the aerosol valve. In one form of the invention, the spring means includes two or more springs for allowing the activator to be moved in a vertical direction for actuating a vertically-movable stem of an aerosol valve. In another form of the invention, the movable spring means includes only one spring for allowing the activator to be moved at an angle relative to the stem of the aerosol valve so as to bend the stem to activate it.

In still another form of the present invention, the aerosol activator is provided with an annular locking ring for engaging an annular lip on the spray container surrounding the aerosol valve for locking the aerosol activator in engagement with the aerosol valve, so that the entire contents of the spray container may be dispensed. In accordance with the present invention, the annular locking ring is formed of a plastic material, and as the annular lip of the spray container is formed of a metallic material, there is an improved engagement between the plastic, annular locking ring and the metallic, annular lip of the spray container for locking the aerosol activator in engagement with the aerosol valve to insure that the entire contents of the spray container are dispensed.

In still another form of the present invention, the aerosol dispensing hole of the aerosol activator is provided with a removable tab formed over the dispensing hole for covering it before it may be used. In this manner, the aerosol activator is child proof, since a child cannot remove the covering tab in order to dispense the aerosol spray.

In accordance with the present invention, there is also provided an improved locking arrangement between the cover and the aerosol spray container. More particularly, a continuous annular locking rim is formed on the inner surface of the cover for engaging an outer lip on the spray container in order to more securely hold the cover in engagement with the spray container.

Advantageously, as a result of the present invention, as the aerosol activator is formed on the inside surface of the top wall of the cover, the cover does not have to be removed in order to move the aerosol activator into engagement with the aerosol valve. Also, as a result of the present invention, since the aerosol activator is provided with an annular ring formed of plastic and is adapted to be locked onto the metal material of the spray container, there is an improved engagement between the plastic annular locking ring of the aerosol activator and the metallic annular lip of the spray container.

Further objects, features, and advantages of the present invention will become apparent upon the consideration of the following detailed description of presently-preferred embodiments, when taken in conjunction with the accompanying drawings.

DETAILED DISCUSSION OF PREFERRED EMBODIMENTS OF THE PRESENT INVENTION

Figure 1:
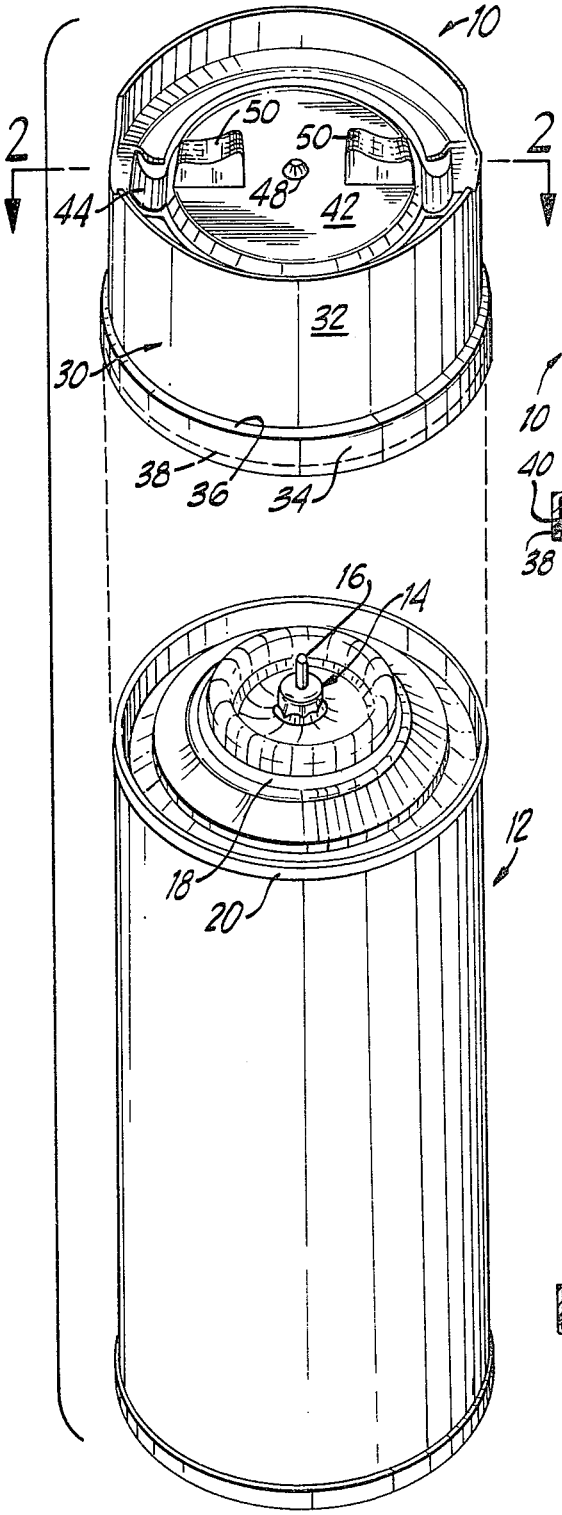
FIG. 1 is a perspective view of an aerosol spray container and the improved cover-aerosol activator embodying the principles of the present invention.

Referring now to FIG. 1, there is shown a cover embodying the principles of the present invention generally designated by the reference numeral 10. The cover 10 is formed of plastic material and is for covering an aerosol spray container 12 which includes an aerosol valve 14 having a stem 16. In addition, in a conventional manner, the top of the aerosol container 12 is formed of metallic material and is provided with an inner annular lip 18, for a purpose to be explained, and an outer annular lip 20 for receiving cover 10.

The cover 10 includes an outer circular wall 30 having an upper section 32 and a lower section 34 interconnected by an offset section 36. As shown most clearly in FIG. 2, lower section 34 includes a continuous annular locking rim 38 formed on the inner surface thereof for engaging the outer annular lip 20 on container 12. As will be understood, locking rim 38 forms a press-fit connection with annular lip 20, and as locking rim 38 is continuous, it forms a continuous channel 40 between offset section 36 and locking rim 38 for receiving the annular lip 20 of the container. In this manner, as there is a continuous and complete engagement all the way around the container between the channel 40 of the cover and the annular lip 20 of the container, an improved and more secure connection is provided between the cover 10 and the container 12.

Cover 10 is also provided with a top wall 42 which is connected to circular wall 30 by springs 44. The top wall 42 includes an aerosol activator 46 integrally formed on the inside surface 42*a* of top wall 42 for activating the aerosol valve stem 16. In addition, aerosol activator 46 includes a dispensing hole 48 formed therein for dispensing the aerosol spray. Also, the upper surface 42*b* of top wall 42 is provided with projections 50 which are adapted to be simultaneously actuated by the fingers of the operator, in a manner to be explained.

Figure 2:
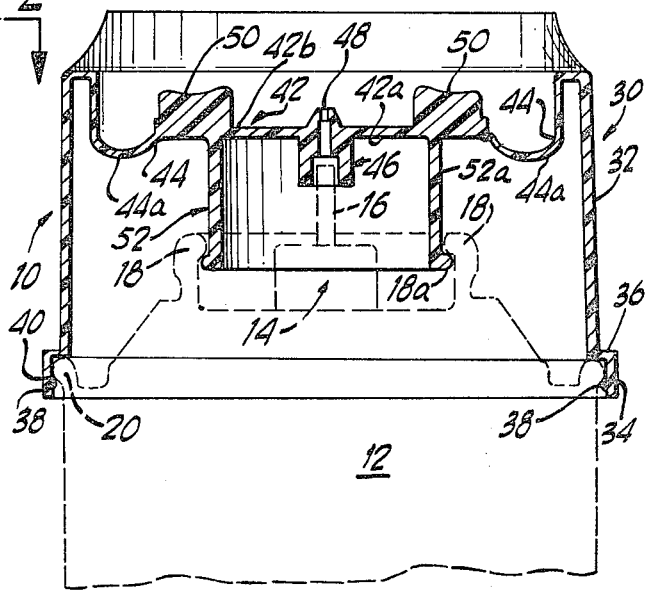
FIG. 2 is a cross-sectional view, taken on line 2—2 of FIG. 1, illustrating in detail the cover shown in FIG. 1.

Referring to FIG. 2, the inside surface 42*a* of top wall 42 is also provided with an annular locking ring 52 which projects downwardly from surface 42*a*. In the preferred embodiment, annular locking ring 52 is integrally formed with the top wall 42. In addition, as stated above, spring members 44 are provided for interconnecting outer wall 30 and top wall 42, so that top wall 42, aerosol activator 46, and annular locking ring 52 can be moved from an inoperative position downwardly to an operative position. More particularly, spring members 44 are formed with a slight loop or belly 44*a*, so that the activator 46 and annular locking ring 52 can be moved downwardly relative to outer circular wall 30 and into the operative position. In the operative position, aerosol activator 46 pushes downwardly in a vertical direction against stem 16 to activate the aerosol valve. Simultaneously, annular locking ring 52 is moved downwardly into press-fit engagement with inner annular lip 18 of the container, so that the outer surface 52*a* of annular locking ring 52 is brought into locking engagement with the inner surface 18*a* of annular lip 18. In this manner, the operator pushes down on projections 50, and annular locking ring 52 engages annular lip 18 and maintains the aerosol activator 46 in locking engagement with the aerosol valve stem 16. The operator can then release the projections, and the entire contents of the spray container 12 will be dispensed.

Figure 3:
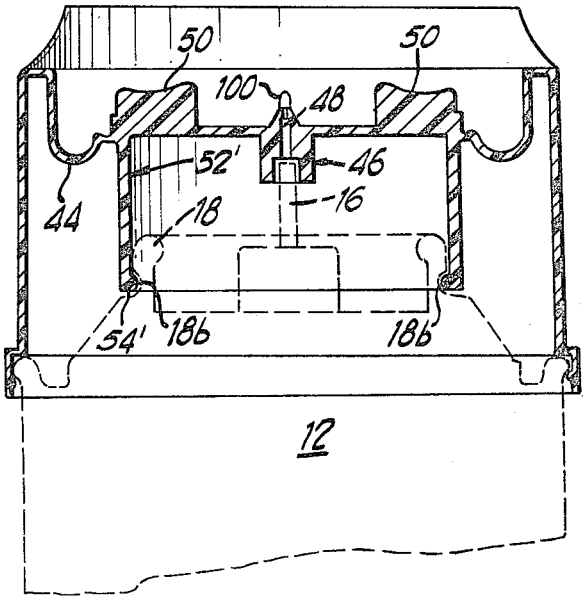
FIG. 3 is a cross-sectional view of a modified form of the cover shown in FIG. 1.

Referring now to FIG. 3, there is shown an alternative embodiment in accordance with the present invention, wherein like reference numerals designate like parts. In this alternative embodiment, annular locking ring 52' is of a larger diameter than annular locking ring 52 and includes an annular locking rim 54' formed on the inner surface thereof. In this manner, when aerosol activator 46 is pushed downwardly into its operative position, locking rim 54' is moved into press-fit engagement with an annular groove 18*b* formed on the outside surface of annular lip 18. In this manner, aerosol activator 46 is maintained in locking engagement with aerosol valve stem 16, so that the entire contents of the spray container may be dispensed.

Figure 4:
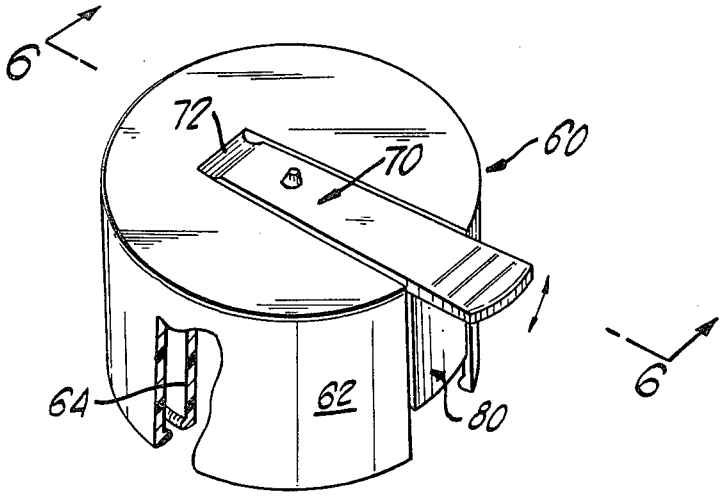
FIG. 4 is a perspective view of another aerosol device embodying the principles of the present invention.
Figure 7:
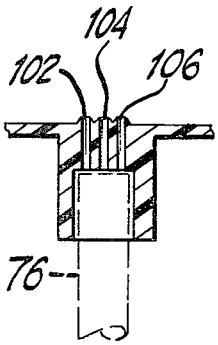
FIG. 7 is a view illustrating the improved dispensing hole arrangement of the present invention.
Figure 5:
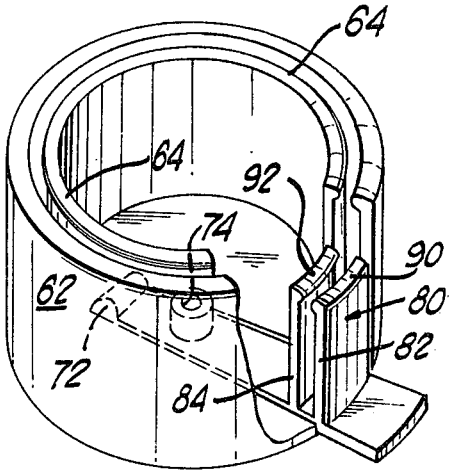
FIG. 5 is a bottom perspective view of the aerosol device shown in FIG. 4.
Figure 6:
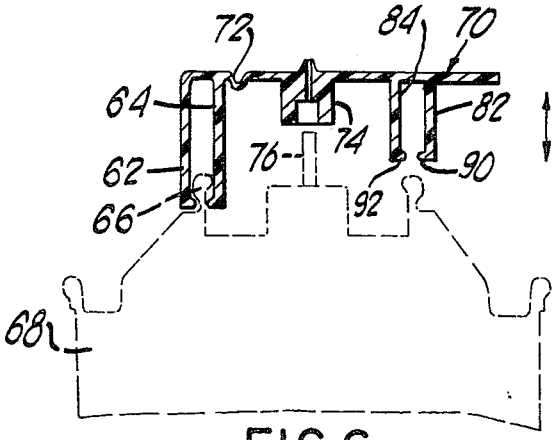
FIG. 6 is a sectional view, taken on line 6—6 of FIG. 4, illustrating the device shown in FIG. 4.

Referring now to FIGS. 4 to 6, there is shown an alternative embodiment of the present invention. As shown therein, the aerosol device 60 includes an outer wall 62 which cooperates with an inner wall 64 for engaging annular lip 66 of spray can 68. As will be noted, walls 62, 64 are not continuous and because of this, it is necessary to provide the double-wall construction in order for device 60 to securely engage spray container can 68. Device 60 is provided with an activator handle 70 integrally formed therewith. In particular, activator handle 70 is connected to device 60 by a suitable spring or hinge connection 72 so that activator handle 70 can be moved up and down on an angle relative to walls 62, 64. Activator handle 70 further includes an activator 74 integrally formed on the undersurface thereof for activating the aerosol valve stem 76 of can 68. In addition, in order to maintain activator 74 in engagement with stem 76, a suitable locking device 80 is provided on the undersurface of activator handle 70. Locking device 80 may include either or both locking lugs 82, 84 for movement into engagement with annular lip 66 of can 68. As shown, the inner surface of locking lug 82 may be provided with a locking rim 90 for engagement with the outer surface of annular lip 66. In addition, the outer surface of locking lug 84 is provided with a locking rim 92 or other suitable means for engaging the inner surface of annular lip 66. As will be understood, optimum locking performance is provided by using both locking lugs 82, 84 for engaging lip 66. However, in accordance with the present invention, either of locking lugs 82, 84 may be employed instead of both. As will be understood, when activator handle 70 is moved downwardly into its operative position so that activating device 74 is brought into contact with valve stem 76, stem 76 is bent or actuated in a sideways direction to dispense the aerosol. In addition, when activator handle 70 is moved downwardly, locking device 80 is brought into contact with annular lip 66, and locking device 80 operates to maintain activator 74 in locking engagement with aerosol valve stem 76 so that the entire contents of the container may be dispensed.

As shown in FIG. 3, aerosol dispensing hole 48 may be provided with a tab 100 formed over the dispensing hole for covering it to prevent inadvertent actuation of the aerosol valve. When it is desired to dispense the aerosol, it is necessary to cut off or otherwise remove the tab 100 formed over the dispensing hole 48. In this manner, a simple and economical child-proof device is provided in the aerosol activator of the present invention. Additionally, in order to improve the effectiveness and rate at which the aerosol is dispensed, the present invention also envisions employing a plurality of dispensing holes, such as three dispensing holes 102, 104, 106, preferably formed in the pattern of a triangle. As a result, it has been found that the rate of dispensing is substantially increased.

In view of the foregoing, it will be appreciated that there has been provided in accordance with the present invention an improved aerosol cover combined with an aerosol activator so that the cover does not have to be removed from the spray container in order to actuate the aerosol device to dispense material. Additionally, as a result of the present invention, the annular locking ring is formed of plastic material and is adapted to directly engage a lip of the spray container formed of metallic material. As a result of this plastic-to-metal contact, the locking engagement between the aerosol activator and the spray can is substantially improved.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An integrated cap for an aerosol container, which container includes a top having an aerosol valve and an annular lip surrounding the aerosol valve, said cap comprising covering means for covering the aerosol valve of the container; positioning means formed integrally with said covering means for positioning said covering means above the aerosol valve of the container, said positioning means including connecting means for connecting said covering means to said positioning means such that said covering means is linearly movable relative to said positioning means towards the top of the container in a generally vertical direction, said connecting means including a first resilient member attached to said covering means on one side thereof and a second resilient member attached to said covering means on an opposite side thereof; activating means movable with said covering means and integral therewith for activating the aerosol valve of the container when said covering means is moved a predetermined distance towards the top of the container; and locking means movable with said covering means and integral therewith for automatically locking said covering means to the annular lip of the container when said covering means is moved said predetermined distance towards the top of the container, whereby the aerosol valve of the container is continuously activated by said activating means.

2. An integrated cap according to claim 1, further comprising actuating means movable with said covering means and integral therewith for actuating the movement of said covering means towards the top of the container, said actuating means including a first projection positioned adjacent to said first resilient member and a second projection positioned adjacent to said second resilient member, whereby said actuating means facilitates the linear movement of said covering means towards the top of the container.

3. An integrated cap according to claim 2, wherein said first and second projections extend outwardly from said covering means away from the top of the container.

4. An integrated cap according to claim 1, wherein said covering means covers substantially the entire top of the container.

5. An integrated cap according to claim 1, wherein said positioning means includes an annular sidewall.

6. An integrated cap according to claim 5, wherein said sidewall includes engaging means for releasably engaging an outer edge of the container.

7. An integrated cap according to claim 6, wherein said engaging means is an annular locking rim.

8. An integrated cap according to claim 5, wherein said covering means includes a substantially planar disc which is suspended interiorly of said sidewall by said connecting means.

9. An integrated cap according to claim 1, wherein said covering means includes dispensing means for dispensing aerosol discharged from the aerosol valve when the aerosol valve is activated by said activating means.

10. An integrated cap according to claim 9, further comprising inhibiting means for inhibiting the inadvertent dispensing of aerosol from said dispensing means.

11. An integrated cap according to claim 10, wherein said inhibiting means includes a tab formed integrally with said covering means and removably positioned over said dispensing means.

12. An integrated cap according to claim 9, wherein said dispensing means includes a plurality of apertures extending through said covering means.

13. An integrated cap according to claim 9, wherein said dispensing means includes three apertures extending through said covering means, said apertures being arranged in a triangular pattern.

14. An integrated cap according to claim 1, wherein said cap is formed of a plastic material.

15. An integrated cap according to claim 1, wherein said activating means extends outwardly from said covering means towards the top of the container.

16. An integrated cap according to claim 1, wherein said locking means includes an annular locking ring extending outwardly from said covering means towards the top of a container.

17. An integrated cap according to claim 16, wherein said locking ring has a diameter selected so that said locking ring engages an outer circumferential surface of the annular lip of the container.

18. An integrated cap according to claim 16, wherein said locking ring has a diameter selected so that said locking ring engages an inner circumferential surface of the annular lip of the container.

19. An integrated plastic cap for a metallic aerosol container, which container includes a top having an aerosol valve and inner and outer annular lips surrounding the aerosol valve, said cap comprising an annular sidewall, including first locking means for releasably locking said sidewall to the outer annular lip of the container; a generally circular top wall positioned above the aerosol valve of the container interiorly of said sidewall; connecting means formed integrally with said top wall and said sidewall for connecting said top wall to said sidewall such that said top wall is linearly movable relative to said sidewall towards the top of the container in a generally vertical direction, said connecting means including a first resilient member attached to said top wall on one side thereof and a second resilient member attached to said top wall on a diametrically opposite side thereof; activating means movable with said top wall and integral therewith for activating the aerosol valve of the container when said top wall is moved a predetermined distance towards the top of the container, said activating means extending outwardly from said top wall towards the top of the container and including dispensing means for dispensing an aerosol discharged from the aerosol valve when the aerosol valve is activated by said activating means; second locking means movable with said top wall and integral therewith for automatically locking said top wall to the inner annular lip of the container when said top wall is moved said predetermined distance towards the top of the container, whereby the aerosol valve of the container is continuously activated by said activating means, said second locking means including an annular locking ring extending outwardly from said top wall towards the top of the container; inhibiting means for inhibiting inadvertent dispensing of aerosol from said dispensing means, said inhibiting means including a tab formed integrally with said top wall and removably positioned over said dispensing means; and actuating means movable with said top wall and integral therewith for actuating the movement of said top wall towards the top of the container, said actuating means including a first projection positioned adjacent to said first resilient member and a second projection positioned adjacent to said second resilient member, whereby said actuating means facilitates the linear movement of said top wall and hence said activating means towards the top of the container.

* * * * *